US006889457B2

(12) United States Patent
Boddie

(10) Patent No.: US 6,889,457 B2
(45) Date of Patent: May 10, 2005

(54) ART ENSEMBLE

(76) Inventor: Vashner R. Boddie, 1203 Sweetzer Ave., #314, Los Angeles, CA (US) 90069

( * ) Notice: Subject to any disclaimer, the term of this patent is extended or adjusted under 35 U.S.C. 154(b) by 0 days.

(21) Appl. No.: 10/237,948

(22) Filed: Sep. 9, 2002

(65) Prior Publication Data

US 2003/0046845 A1 Mar. 13, 2003

Related U.S. Application Data

(60) Provisional application No. 60/322,098, filed on Sep. 13, 2001.

(51) Int. Cl.[7] ..... G09F 7/04
(52) U.S. Cl. ..... 40/600; 40/711; 434/73
(58) Field of Search ..... 40/600, 661.01, 40/711, 426; 434/73, 134, 168

(56) References Cited

U.S. PATENT DOCUMENTS 3,949,506 A * 4/1976 Benkowski ..... 40/711
4,040,194 A * 8/1977 Penton et al.
4,741,534 A * 5/1988 Rogahn ..... 40/600 X
4,832,605 A * 5/1989 Bragin ..... 434/168
5,295,342 A * 3/1994 Roche et al. ..... 40/600 X
5,505,620 A * 4/1996 Barlett ..... 434/73
6,185,850 B1 * 2/2001 Erkel ..... 40/657

* cited by examiner

*Primary Examiner*—Joanne Silbermann

(57) ABSTRACT

An art ensemble comprising a plurality of art elements to be arranged in different decorative abstract designs on a flat foundation panel and held in place on the panel by insets in the elements containing ferrous material and a sheet of permanent magnet material overlying the foam plastic core of the foundation panel and covered by decorative art paper. The elements have frames covered by decorative materials, including canvas that is either painted or unpainted. Different sizes, colors and patterns are provided in the art elements of a set so that a variety of ensembles may be created from one set.

21 Claims, 4 Drawing Sheets

ART ENSEMBLE

REFERENCE TO PRIOR PROVISIONAL APPLICATION

This application claims the benefit of prior copending provisional application No. 60/322,098 filed Sep. 13, 2001.

BACKGROUND OF THE INVENTION

This invention relates to an art ensemble, and more particularly to a fine art ensemble with components that are arranged to form an artistic creation.

Artwork typically is created by an artist who conceives a particular work of art and then executes the work in a particular medium of the artist's choosing. Then the work is sold or otherwise comes into the hands of the ultimate owner, sometimes the artist himself or herself, and is displayed for the pleasure of the owner and others for whom the owner displays the work.

The general objective of the present invention is to provide a novel art ensemble which provides the owner the opportunity and means for arranging and re-arranging the components of the ensemble in a variety of different works of art, rather than limiting the owner to one fixed work.

BRIEF SUMMARY OF THE INVENTION

The invention comprises a foundation element in the form of a panel having a substantially flat front side, with a decorative front surface providing a background for the art ensemble, a set of a plurality of decorative art elements each having an artistic front surface for facing outwardly from the foundation panel, and interactive releasable connecting elements on the foundation panel and the art elements for holding selected individual art elements in various selected positions and artistic arrangements on the foundation panel. This enables the owner to create different and varying art ensembles from the set of available art elements, thereby providing both unlimited variety in available artwork and the opportunity to satisfy creative needs and desires through the production of two-and three-dimensional patterns and designs. This invention is particularly suited for use in creating abstract artworks.

The preferred foundation element is a relatively large rectangular panel, and the preferred individual art elements also are rectangles that are movable on the panel into different positions and designs. The front surface of the panel preferably is a decorative art paper such as that sold as "Nuba" paper, typically in solid colors, applied as a covering over a suitable core such as lightweight solid foam plastic supported on a wood backing, and a preferred covering for the art elements is canvas pre-stretched over wood frames so as to be adapted to be painted with a variety of artistic designs and decorative colors. Other pre-decorated coverings may be used.

To provide interactive releasable connecting elements, magnetic elements are mounted in both the foundation panel and the art elements, preferably as a sheet of permanent magnet material covering the front side of the foundation panel beneath the front surface of paper and a false back of magnetic material such as paperboard having a layer of ferrous material set into each of the art elements. Rectangular shapes are preferred for the art elements and the foundation panel for ease of manufacture, but any other shape that is desired may be made and used.

Other aspects and advantages of the invention will be apparent from the following drawings and the accompanying detailed description.

DETAILED DESCRIPTION OF THE FIRST EMBODIMENT (FIGS. 1–4)

Figure 1:
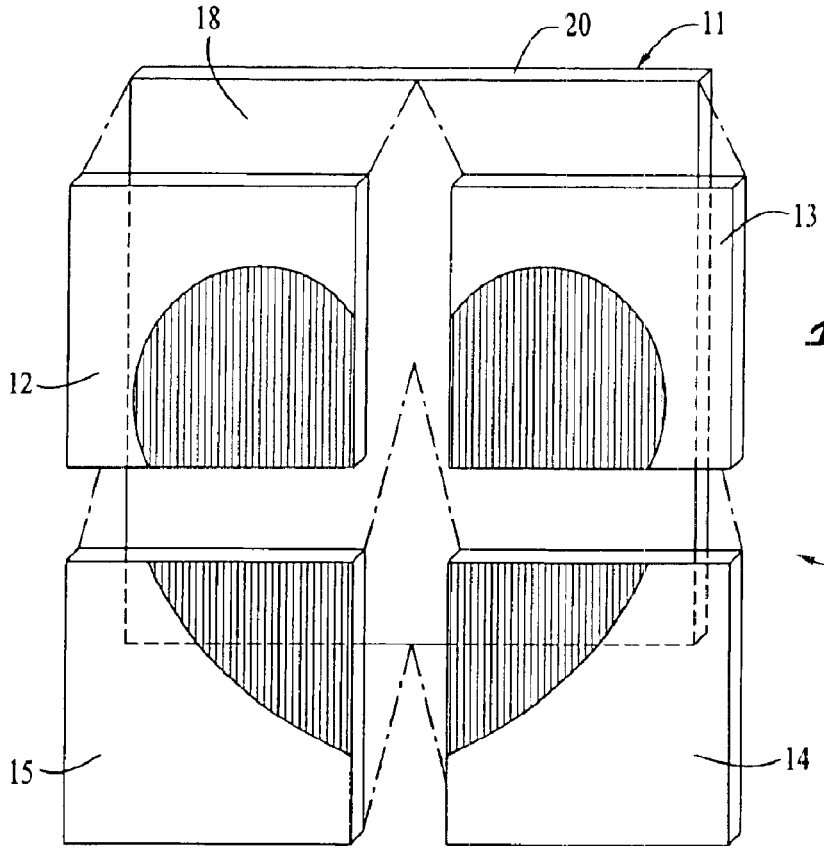
FIG. 1 is a front perspective view of an illustrative art ensemble in accordance with the present invention, with four art elements of a set of six or more elements shown in "exploded" positions overlying the foundation panel and their selected positions on the panel.
Figure 2:
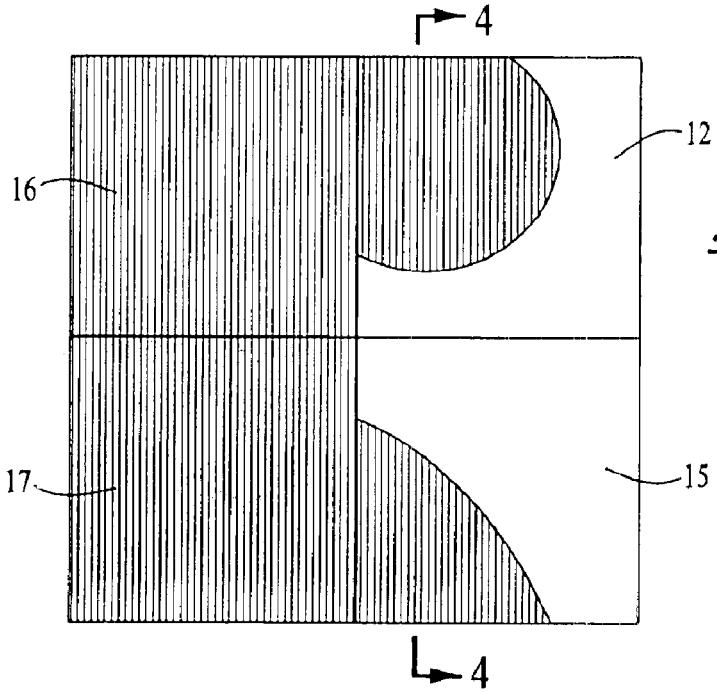
FIG. 2 is a front elevational view of the art ensemble of FIG. 1 with two art elements in moved positions and two additional elements substituted for the other two shown in FIG. 1.
Figure 3:
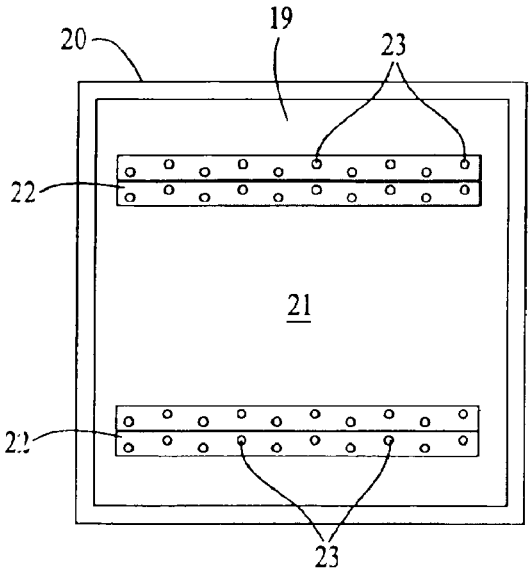
FIG. 3 is a rear elevational view of the art ensemble of FIG. 1 on a reduced scale.

As shown in FIGS. 1–4 for purposes of illustration, the invention is embodied in an art ensemble 10 comprising a foundation panel 11 and a set of art elements 12 through 17 to be arranged over the foundation panel 10 in different decorative and artistic patterns. This provides a piece of art that can be created, displayed and viewed in one configuration, such as the "heart" design shown in FIG. 1, in which four segments of the heart design, in red, are provided on four square art elements 12, 13, 14 and 15, that are overlaid on the foundation panel 11. This design subsequently can be changed into other designs, such as the abstract design shown in FIG. 2 in which two art elements 16 and 17, that may be colored the same red as used for the heart design, are provided to overlie one-half of the foundation panel and two of the other elements 12 and 15 of the set are positioned as shown in FIG. 2. More than six elements may be provided in the set, only six being shown herein, to provide greater opportunities for creative arrangements of this art ensemble.

Figure 4:
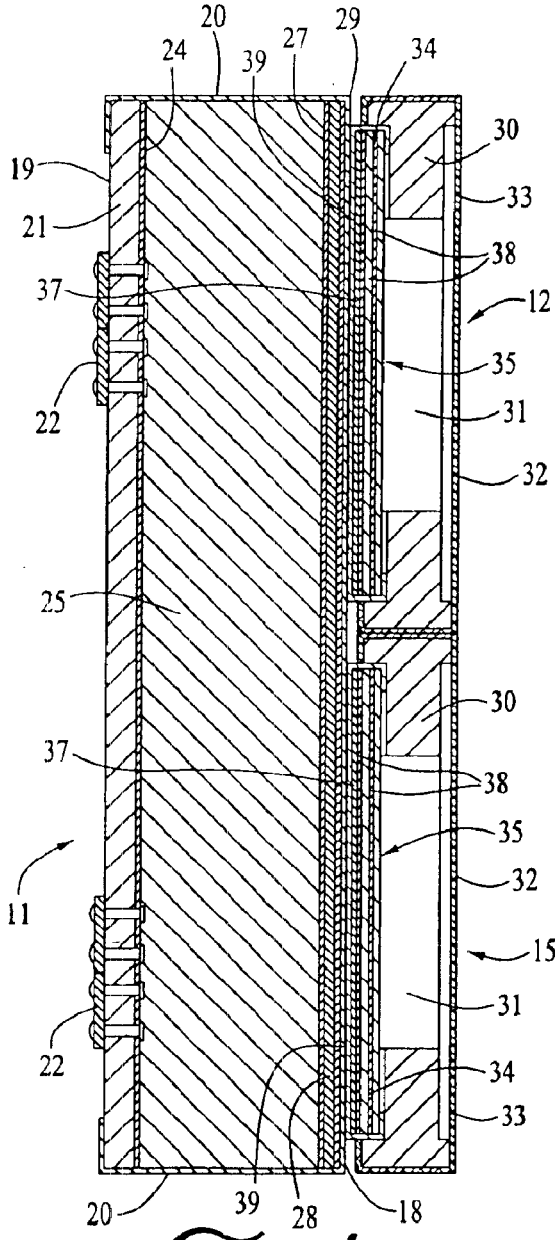
FIG. 4 is a cross-sectional view taken along the line 4—4 of FIG. 2, but compressed longitudinally and not shown to scale so as to provide greater visibility of the various components of the ensemble.

The presently preferred constructions for the foundation panel 11 and the art elements 12 through 17 are shown in FIG. 4. The illustrative panel has front and rear sides 18 and 19 that are substantially square, and relatively thick side edges 20 for a somewhat three-dimensional look, the rear side being the outer side of a backing 21 that preferably is a sheet of wood for structural strength. Two elongated plates 22 are secured to the backing 21 by rivets 23 for use in mounting the ensemble on a supporting surface such as a building wall (not shown). Attached to the backing, herein by a layer 24 of glue shown in FIG. 4, is a foam plastic core 25 that gives the foundation panel thickness without adding great weight, and attached to the front side of the core, herein by another layer 27 of glue, is a sheet of permanent magnet material 28. This sheet covers the front side of the core and itself is covered by a sheet 29 of flexible decorative material that not only overlies the plastic sheet but also covers the side edges 20 and the marginal portions of the back of the foundation panel, as shown in FIG. 4. Thus, the color chosen for the background of the ensemble covers the edges as well. The paper preferably is glued in place for a semi-permanent construction.

While the art elements 12 through 17 could have the same general structure as the foundation panel 11, it is preferred to provide these in a form that permits significantly greater versatility for the invention. As shown in FIG. 4, the preferred construction of these elements comprises a wood frame 30 leaving a hollow center 31, and a canvas covering 32 that is stretched over the frame and its edges in a conventional canvas-mounting manner that includes recesses 33 and 34 in the front and rear sides of the frame. Mounted in this manner, the canvas of each art element may be painted and decorated as an individual art piece, in a solid color or in any desired design or pattern, such as the sections of a heart shown in FIG. 1. Other suitable coverings are pre-painted canvas, pre-existing artwork on other materials, and even pre-decorated fabrics.

Set into the recess 34 in the back of each of the art elements 12 through 17 is a false back, indicated generally by the number 35 that interacts with the permanent magnet material 28 of the foundation panel 11 to hold the element in any selected position on the panel. As shown in FIG. 4 (in exaggerated size for clarity), the illustrative structure comprises a sheet 37 of "paperboard" material having a ferrous metal content for attraction to the permanent magnet, held in place by two layers of chipboard 38 joined by a layer of glue. This false back preferably is wrapped in a covering 39 of decorative material such as flexible paper for an acceptable "finished" look, one possible wrapping being the "Nuba" paper used for the covering of the foundation panel, in any suitable color. Then the false back is set into the recess 32 in the back of the art element and suitably secured in place.

While rectangular art elements are shown, it is to be understood that other shapes may be used, including triangular, circular or oval. Three dimensional objects also may be incorporated in the elements.

Description of Alternative Embodiments (FIGS. 5–8)

Figure 5:
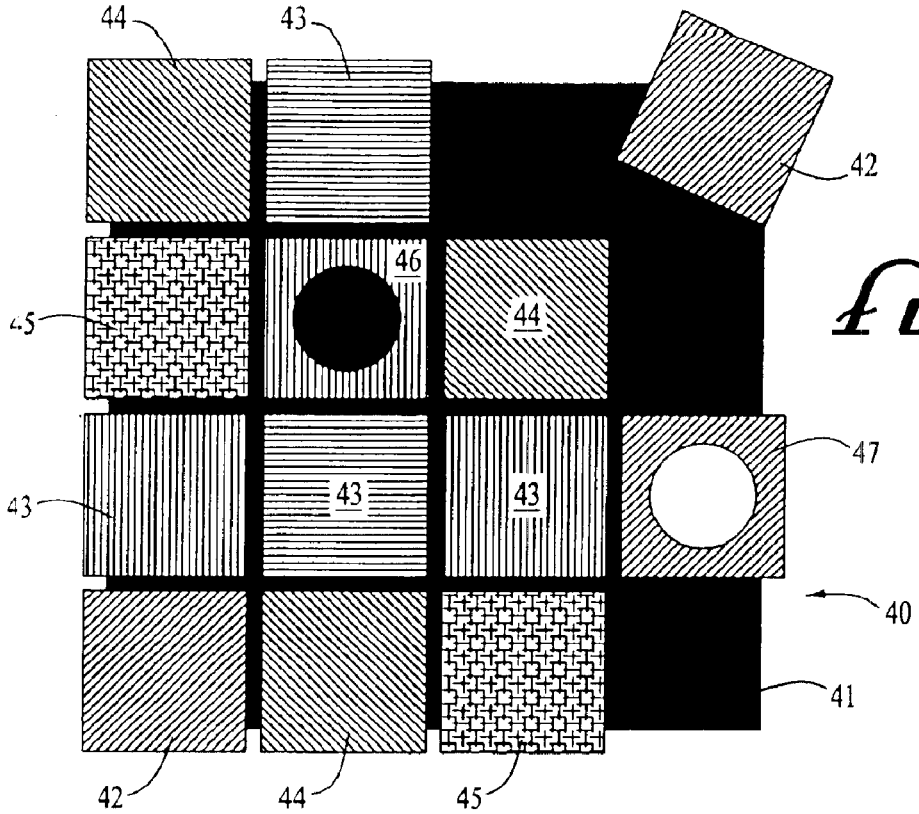
FIG. 5 is a front perspective view of a first alternative embodiment of the invention with selected art elements of a second set disposed in a preselected art ensemble.
Figure 6:
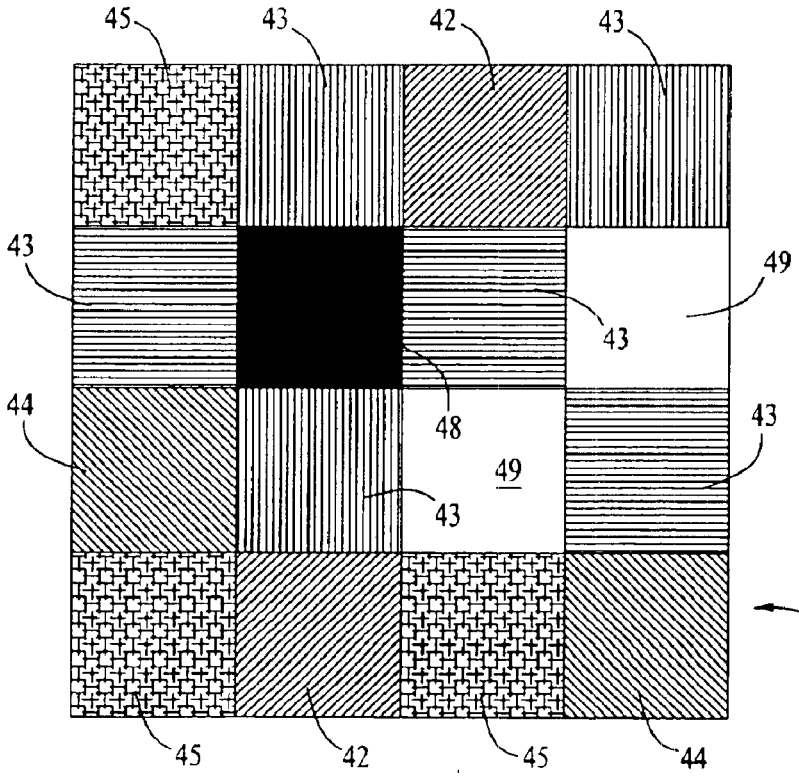
FIG. 6 is a front perspective view of the first alternative embodiment with different selected art elements of the second set disposed in a different art ensemble.

The first alternative embodiment shown in FIGS. 5 and 6 is an art ensemble 40 that comprises a foundation panel 41 similar to the panel 11 of the first embodiment and a larger number of smaller square art elements 42 through 49 in different designs and colors. When assembled in a group of sixteen in tight, side-by-side relation, these art elements almost exactly cover the foundation panel, as shown in FIG. 6. These elements have different colors and designs on their front sides, as indicated schematically in FIGS. 5 and 6, elements with similar designs and colors being indicated by the same numbers. Thus, selected elements can be arranged by the owner or user in an almost endless variety of different patterns and designs.

It will be seen that the full coverage in FIG. 6 uses sixteen art elements of the first alternative set. In FIG. 5, however, additional art elements 46 and 47 are shown, with circular designs applied to them, to show that the set of elements of this embodiment is larger than the sixteen shown in FIG. 6, which also includes three additional solid elements 48 and 49. Moreover, the thirteen elements in FIG. 5 are arranged in spaced relation, with one 42 in an angled position at one corner and with those along the margins of the foundation panel overhanging the side edges of the panel. This illustrates the freedom of creativity that is presented by the invention.

Figure 7:
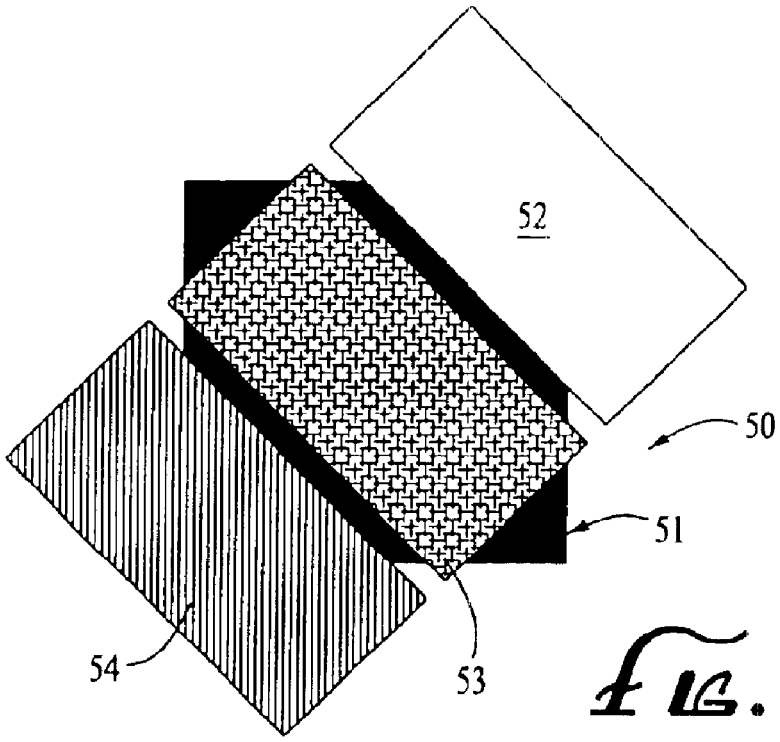
FIG. 7 is a front perspective view of a second alternative embodiment of the invention, shown on a smaller scale with three art elements of a third set of elements disposed in a preselected art ensemble.
Figure 8:
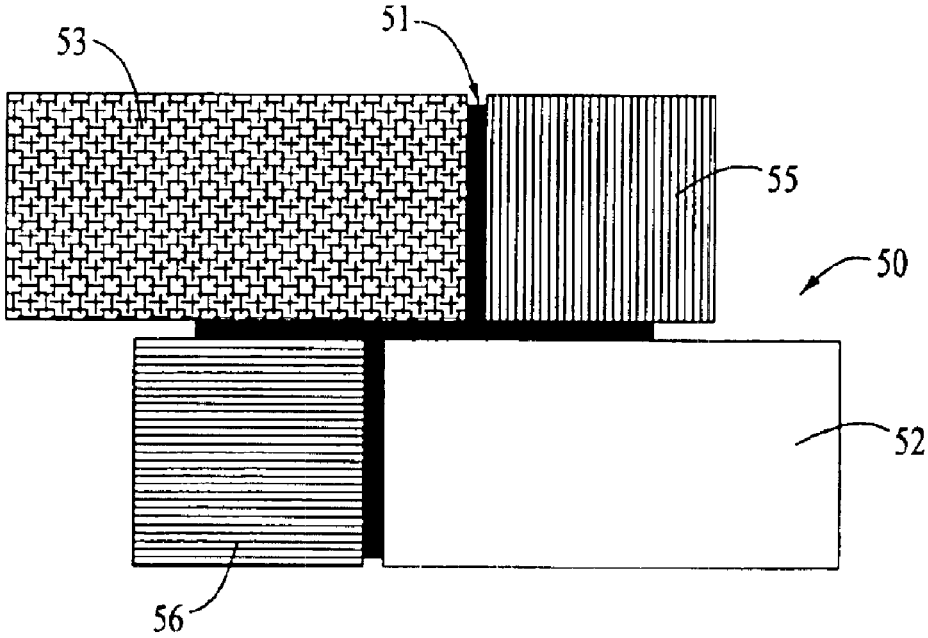
FIG. 8 is a view similar to FIG. 7 showing four art elements of the third set of elements disposed in a different art ensemble.

Shown in FIGS. 7 and 8 is a second alternative embodiment of an art ensemble 50 in which a square foundation panel 51 similar to the panels 11 and 41 serves as a background for a set of art elements including elements 52 and 53 that are shown in the two views, and three additional elements 54, 55 and 56. Each of the three elongated rectangular elements 52, 53 and 54 is approximately the size and shape of one-half of the foundation panel, and these three elements are arranged in generally parallel, angularly disposed positions in the art ensemble 50 in FIG. 7, in an array that is substantially larger than the foundation panel. In FIG. 8, the two elements 52 and 53 are combined with two square elements 55 and 56, and the four elements are arranged in two rows in horizontally disposed positions overhanging the edges of the panel 51. Colors and patterns are applied and selected in accordance with artistic preference, the results being abstract art pieces of the creator's own choice and creation. The construction of the foundation panel and the art elements in the alternative embodiments preferably is the same as in the first embodiment.

It is to be noted that the art ensemble of the invention can be provided with pre-decorated art elements or with undecorated elements that are ready for custom decoration by the artist/owner. In the latter event, unpainted canvas coverings are provided, to be painted with any desired color, design or pattern that the artist/owner wishes to use in an ensemble. This system also lends itself to the application of "Feng Shui" principles pertaining to the manipulation and management of "Chi" life energy to alter the energy of a room.

Accordingly, it will be evident that the present invention provides an abstract art creation system that fulfills the need for fine abstract art while accommodating the artist/owner's need for variety and change. A given piece of artwork can be enjoyed in its original form and then changed into a totally different piece that suits the taste and mood of the creator. It also will be seen that, while one specific structural embodiment has been disclosed, along with alternative design alternatives, various modifications and changes may be made within the spirit and scope of the invention.

I claim as my invention:

1. An art ensemble having:

a rectangular foundation panel adapted to be hung on a wall or other supporting surface and comprising a lightweight core composed of solid foam plastic having opposite substantially flat rectangular sides and relatively thin edges, a rectangular backing composed of structurally stiff material and substantially covering one of said sides, at least one hanger bar attached to said backing for mounting the panel on the supporting surface, a sheet of magnetic material substantially covering the other of said sides, and a wrapping of first decorative flexible sheet material substantially covering said edges and said magnet material and providing a substantially flat artistic front display surface for said panel;

and a plurality of decorative art elements smaller than said display surface for mounting in different positions and arrangements on said display surface in selected and variable positions to create distinctive individualized displays on said foundation panel, each said art elements having:

a front surface having a substantially flat back surface, relatively thin edge surfaces, and a preselected individual shape and decor, an internal frame defining the outside shape of the element, and a wrapping of second decorative flexible sheet material substantially covering the front and edge surfaces of the art element, and a magnetic inset in back of the art element;

said sheet of magnetic material and said magnetic inset being composed of interactive materials for holding the art elements firmly but releasably in various artistically selected positions on said decorative surface to create the art ensemble.

2. An art ensemble as defined in claim 1 wherein said first decorative flexible sheet material is of one solid color for said foundation panel.

3. An art ensemble as defined in claim 2 wherein said first sheet material is Nuba paper.

4. An art ensemble as defined in claim 1 wherein said second decorative flexible sheet material for said art elements is canvas.

5. An art ensemble as defined in claim 4 wherein the canvas material of said art elements is of different selected artistic colors to be arranged in different colorful material of said art elements is of different selected artistic colors to be arranged in different colorful patterns on said foundation panel.

6. An art ensemble as defined in claim 5 wherein selected ones of said art elements have segments of artistically designed shapes on the front surfaces thereof.

7. An art ensemble as defined in claim 6 wherein said artistically designed shapes include segments on different art elements to be fitted together in composite design shapes comprising more than one art element.

8. An art ensemble as defined in claim 1 wherein all of the art elements are rectangular in shape.

9. An art ensemble as defined in claim 8 wherein all of the art elements are of different sizes and rectangular shapes.

10. An art ensemble as defined in claim 1 wherein the wrapping of at least some of said art elements is unpainted canvas suitable for being decorated in a custom fashion.

11. An art ensemble as defined in claim 1 wherein said sheet of magnetic material is composed of permanent magnet material and said magnetic inset is composed of a ferrous material.

12. An art ensemble as defined in claim 1 wherein the plurality of art elements comprises a set of decorated rectangles having a combined surface area larger than the surface area of the display surface of said foundation panel, whereby only a portion of said set may be arranged in a decorative pattern on the display surface and alternatively, portions of the art elements may be mounted in overhanging positions on the display surface.

13. An art ensemble comprising:

a foundation panel having a substantially flat front side and including a decorative front surface providing a background for said art ensemble;

a set of a plurality of decorative art elements each having a back surface for facing toward and overlying a portion of said front surface of said foundation panel, an artistic front surface for facing outwardly from said foundation panel, a selected member of said art elements being disposed in an artistic arrangement overlying said front surface of said foundation panel;

interactive releasable connecting elements on said foundation panel and said art elements for holding said selected number of art elements in said artistic arrangement and permitting re-arrangement of the selected number of art elements on said front surface and changing of art elements from said set in said selected number in a different artistic arrangement; and wherein said decorative art elements comprise frames having front surfaces substantially covered with sheets of decorative artistic material.

14. An art ensemble as defined in claim 13 wherein said releasable connecting elements comprise a sheet of permanent magnet material beneath said front surface, and an inset in the back surface of each of said art elements containing ferrous material.

15. An art ensemble as defined in claim 14 wherein said sheet of permanent magnet material is covered by a sheet of flexible artistic paper and said decorative art elements are frames that are covered with canvas, said insets being set into the backs of said frames.

16. An art ensemble as defined in claim 13 wherein said decorative front surface comprises a flexible sheet of artistic material substantially covering the front of said foundation panel.

17. An art ensemble as defined in claim 13 wherein said material is canvas.

18. An art ensemble as defined in claim 17 wherein at least some of the decorative art elements have front surfaces of unpainted canvas.

19. An art ensemble as defined in claim 17 wherein the canvas material of said art elements is of different selected artistic colors to be arranged in different colorful material of said art elements is of different selected artistic colors to be arranged in different colorful patterns on said foundation panel.

20. An art ensemble as defined in claim 13 wherein first surface of said foundation panel is rectangular and of preselected size, and said art elements are of smaller sizes to be accommodated in various artistic arrangements on said foundation panel.

21. An art ensemble as defined in claim 13 wherein the plurality of art elements comprises a set of decorated rectangles having a combined surface area larger than the surface area of the display surface of said foundation panel, whereby only a portion of said set may be arranged in a decorative pattern on the display surface and alternatively, portions of the art elements may be mounted in overhanging positions on the display surface.

* * * * *